United States Patent [19]

Parramore

[11] Patent Number: 4,972,538

[45] Date of Patent: Nov. 27, 1990

[54] LAUNCHING APPARATUS FOR TRANSPORTABLE BRIDGES

[75] Inventor: Thomas S. Parramore, Bournemouth, England

[73] Assignee: The Secretary of State for Defence in Her Britannic Majesty's Government of the United Kingdom of Great Britain and Northern Ireland, London, England

[21] Appl. No.: 237,360

[22] Filed: Feb. 6, 1981

[30] Foreign Application Priority Data

Mar. 4, 1980 [GB] United Kingdom ..... 8006615

[51] Int. Cl.[5] ..... E01D 1/00

[52] U.S. Cl. ..... 14/1; 14/2.4; 14/2.6

[58] Field of Search ..... 14/1, 2.4, 2.6

[56] References Cited

U.S. PATENT DOCUMENTS 3,820,181 6/1974 Wagner ..... 14/2.4

FOREIGN PATENT DOCUMENTS 1224350 9/1966 Fed. Rep. of Germany ..... 14/2.4

383771 2/1974 U.S.S.R. ..... 14/2.4

*Primary Examiner*—Donald P. Walsh

*Attorney, Agent, or Firm*—Pollock, Vande Sande and Priddy

[57] ABSTRACT

A bridge span consisting of a series of end-to-end engageable bridge modules can be launched across a gap from a launch vehicle with the aid of an overhead launch rail consisting of a series of end-to-end engageable launch rail modules, the rail having been previously cantilevered out across the gap from the vehicle. The launch rail carries a cable-driven trolley beneath which the leading end of the bridge span is slung, after the leading end of the rail has been located upon the far bank, and the span then winched out so as to bridge the gap.

8 Claims, 5 Drawing Sheets

LAUNCHING APPARATUS FOR TRANSPORTABLE BRIDGES

This invention relates to launching apparatus for transportable bridges.

Many transportable bridges of varying degrees of complexity are known, ranging from those in which separate component parts are brought together on site and assembled manually to those in which all the component parts are articulated together and folded onto a single transporter/launcher vehicle from which they are deployed by fully mechanized means.

The main disadvantage of the simple, manually assembled types is the length of time needed for construction, and the disadvantage of the fully mechanized types is the unwieldy proportions of the transporter/launcher vehicle and its consequent lack of manoeuvrability in transit.

The present invention seeks to achieve a compromise solution to the problem by providing a mechanical launching aid for use with a hand-constructed bridge. Accordingly, launching apparatus for a transportable bridge having a plurality of bridge span modules inter-engageable end-to-end to form a bridge span includes: an extensible launch rail; a cantilever support frame engageable with the launch rail having drive means for advancing and retracting the launch rail there-through; and ground engageable support member attachable adjacent the end of the launch rail remote from the cantilever support frame; and a launch trolley driveable on the launch rail and adapted for underslinging one end of the bridge span so as to advance and retract the bridge span beneath the launch rail.

Preferably the cantilever support frame is angularly deflectable about an axis normal to the launch rail and substantially horizontal in use, thereby permitting adjustment of the height of the free end of the launch rail.

The launch rail may conveniently comprise a plurality of launch rail modules inter-engageable end-to-end, so that each module may be joined in turn to the proceding one as it is fed to the support frame.

The cantilever support frame may be advantageously mounted upon a launch vehicle, which vehicle also transports the launch trolley and the launch rail modules and further includes a bridge module support frame for slideably supporting the bridge span modules during assembly and advancement and during retraction and dismantling. The bridge module support frame is preferably angularly deflectable about an axis parallel to the deflection axis of the cantilever support frame. The bridge modules are preferably transported upon separate vehicles and the launch vehicle may conveniently include a crane for lifting the bridge modules onto the bridge module support frame.

The ground engageable support member may conveniently comprise a bipedal leg pendently attachable to the launch rail so as to be substantially perpendicular thereto, its two feet being aligned transversely to the launch rail.

The launch trolley may conveniently be cable driven by winch means mounted on the cantilever support frame.

Figure 1:
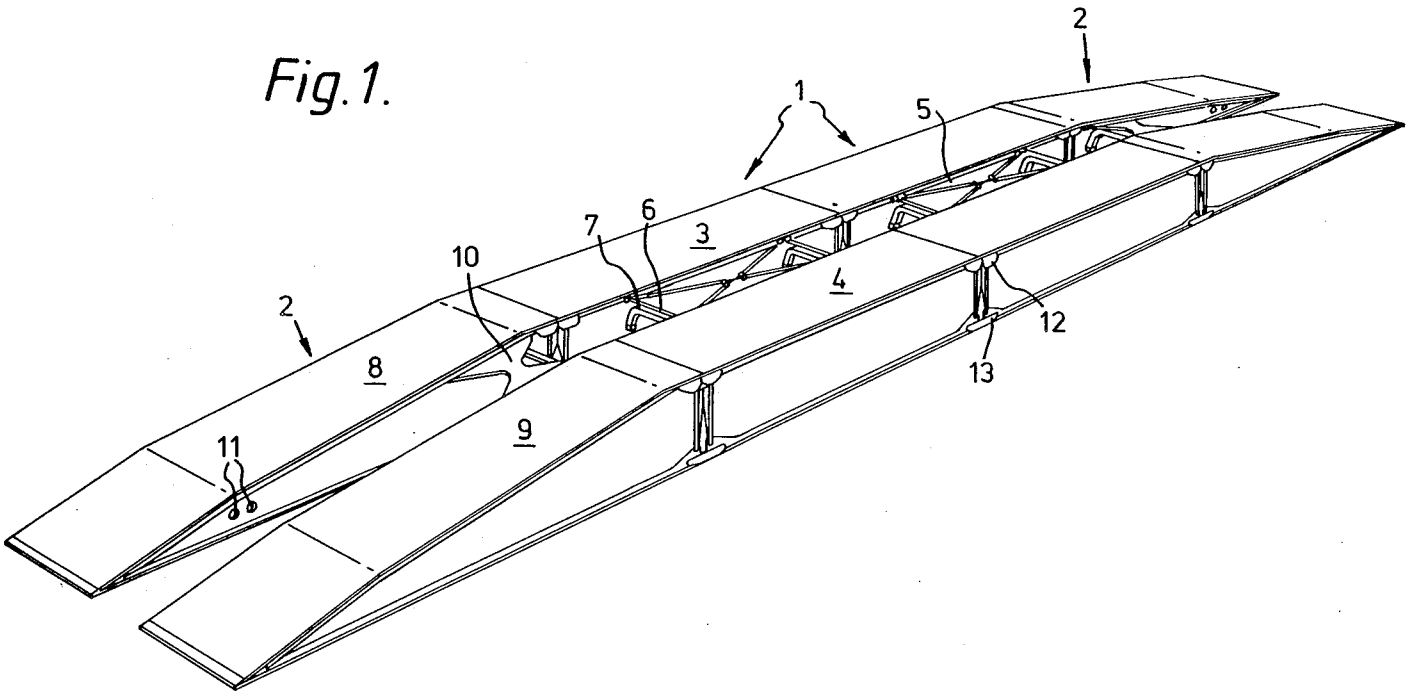
Figure 2:
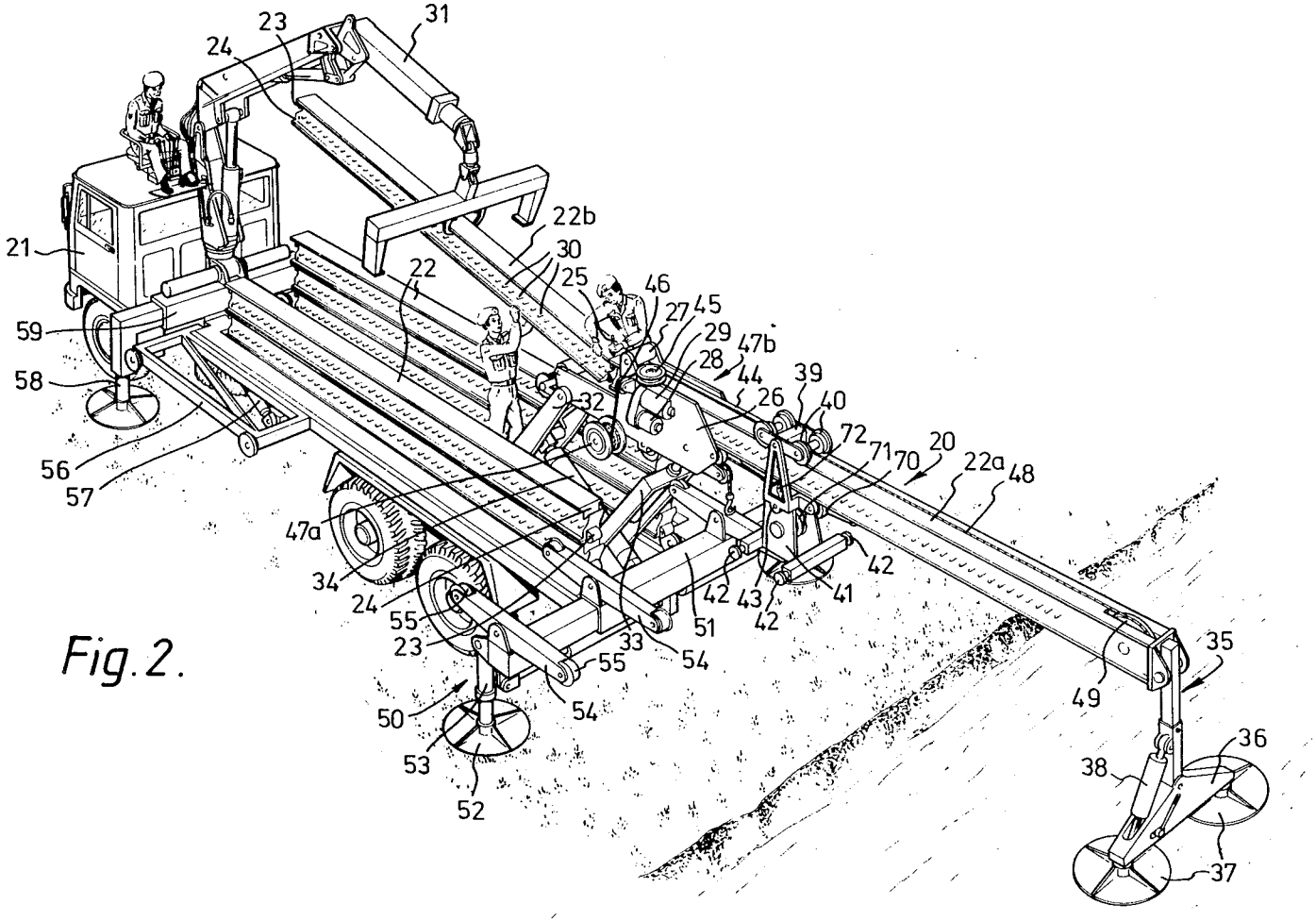
Figure 3:
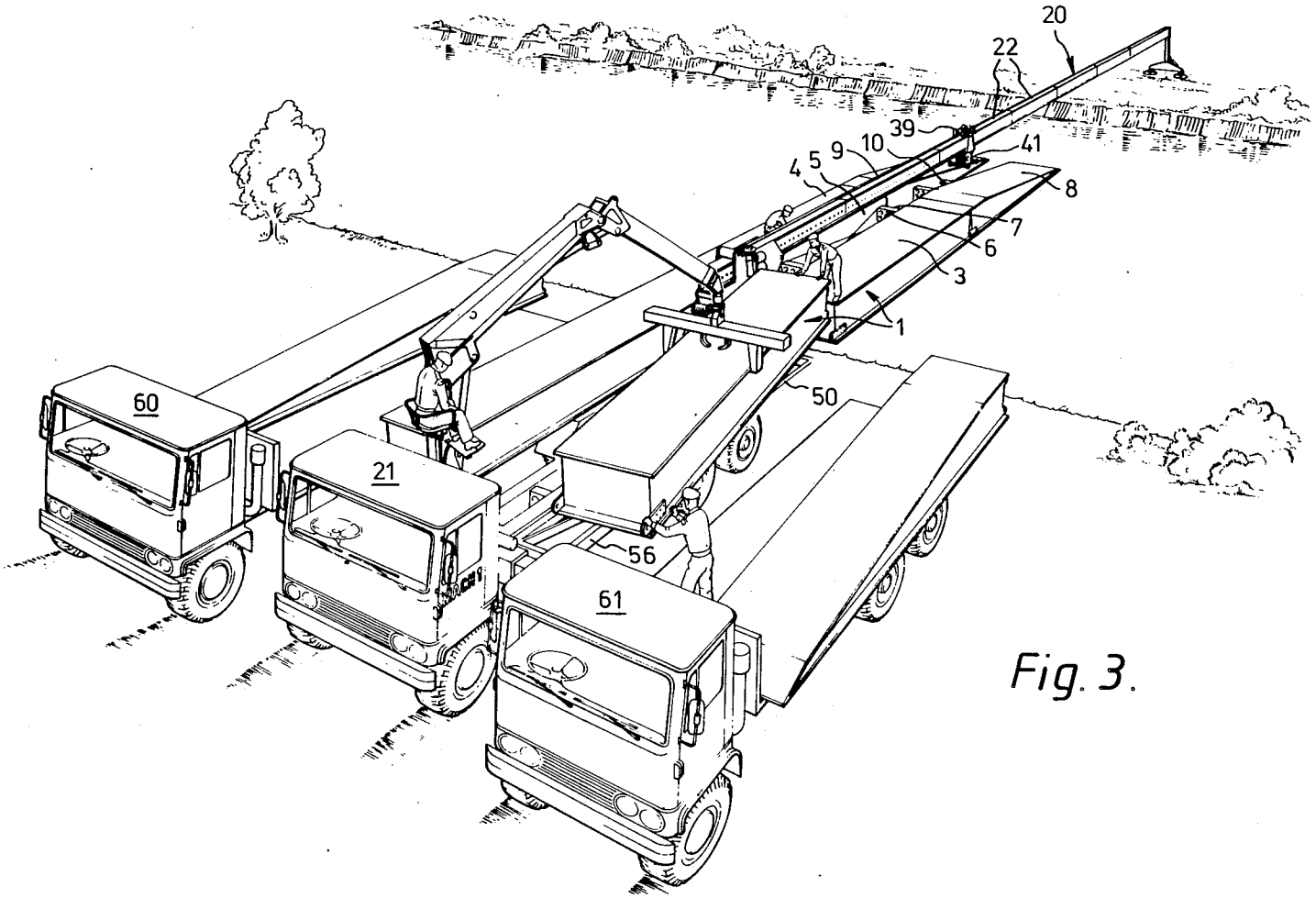
Figure 4:
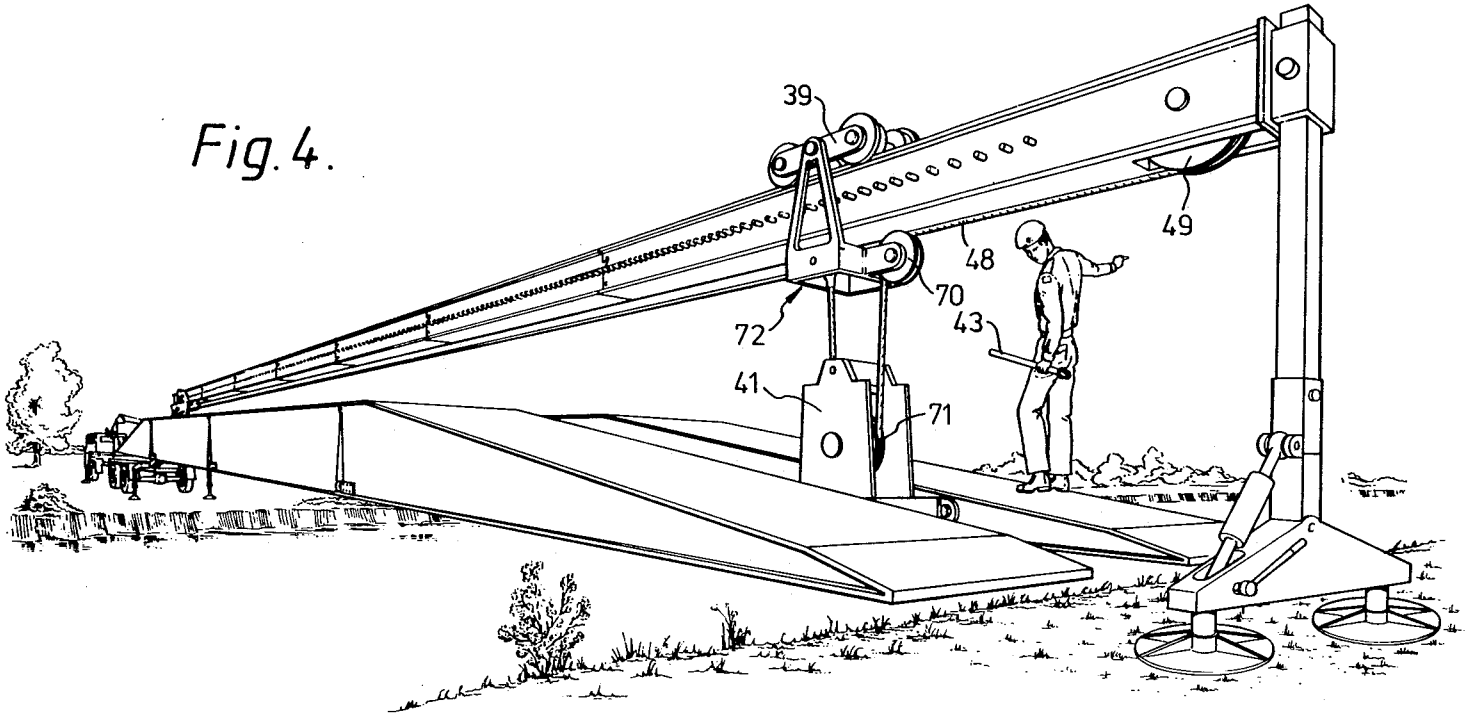
Figure 5:
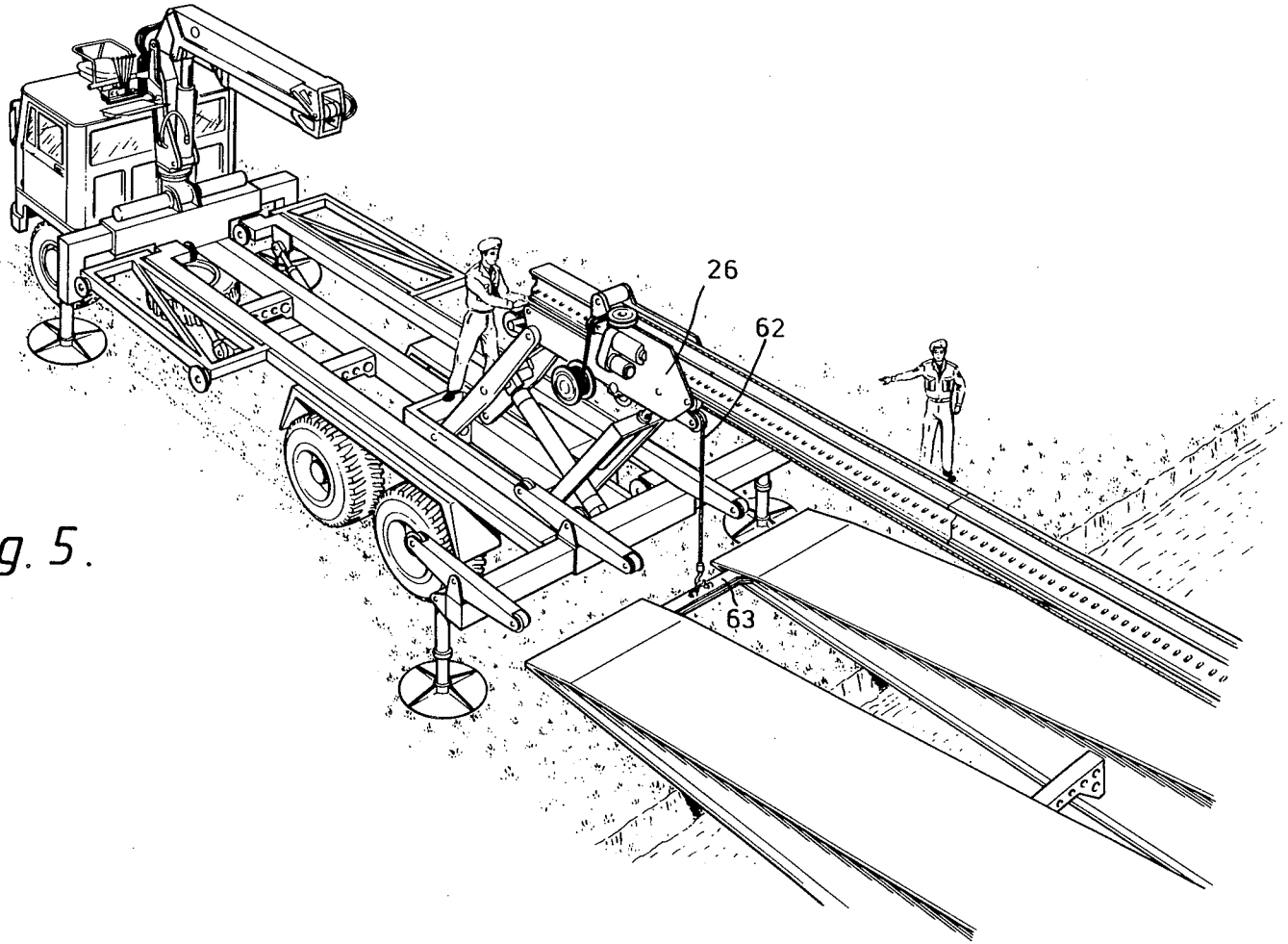

An embodiment of the invention will now be described by way of example only with reference to the accompanying drawings of which FIG. 1 is a view of a four-module bridge span, FIG. 2 is a view of a launch vehicle illustrating launch rail assembly and advancement, FIG. 3 is a view of the same launch vehicle with the launch rail fully advanced and emplaced, illustrating assembly and advancement of the bridge span of FIG. 1, and FIGS. 4 and 5 illustrate emplacement of the bridge span ends upon the far bank and the home bank respectively.

The bridge span illustrated in FIG. 1 is assembled from two identical inner modules 1 and two identical ramped end modules 2. Each inner module 1 consists of two parallel sheet web light alloy girders comprising twin track-ways 3 and 4 interconnected by sway braces 5 and top and bottom cross-connectors 6 and 7 respectively. Each end module 2 consists of two sheet web tapered girders comprising twin ramped track-ways 8 and 9 interconnected by a bracing frame 10. Sling sockets 11 are provided in the opposing side faces of the ramped track-ways 8 and 9 for use during launch.

The modules 1 and 2 are interconnected end-to-end by means of pinned joints 12 and 13, and in-fill panels (not shown) can be laid across the center gap after launching to form a continuous decking.

The bridge span is assembled and launched with the aid of a launch rail 20 mounted upon a launch vehicle 21 illustrated in FIG. 2. The launch rail 20 consists of seven identical launch rail modules 22, each comprising a box girder connectable end-to-end by male and female jaws 23 and 24 secured by pins 25, the pinned jaws being dimensioned to hog when the rail is cantilevered out. The rail 20 is launched rearwardly from the vehicle 21 via a cantilever support frame 26, each module 22 being advanced in turn through flanged guide rollers 27 located above and below the rail which rollers react against the cantilever bending moment of the rail.

Drive means for advancing the launch rail comprise a hydraulic motor 28 which rotates a worm 29 enmeshing with a series of roller pegs 30 pitched along the centre-line on one side of each module 22. (The drive may be alternatively transmitted directly to the launch rail module by means of rubber rollers, not shown). Limit switches (not shown) are used to stop the drive adjacent the end of each module 22 so as to permit the next successive module 22 to be engaged before further outward drive is applied. A crane 31 mounted on the vehicle 21 is provided for lifting the modules 22 into position for connection.

The cantilever support frame 26, which is attached to the chassis of the vehicle 21 via pivoted linkages 32 and 33 can be tilted by means of a hydraulic ram 34 so that the vertical launch angle of the rail 20 can be adjusted to suit the height of the far bank of the gap being bridged. The leading launch rail module **22*a* remains in the cantilever support frame 26 for transportation, the frame being retracted from the rear end of the vehicle by means of the ram 34**.

The module **22*a* carries at its outward end a pendant leg 35 having a cross beam 36 pivotally attached at its lower end which supports two articulated ground bearing pads 37. The cross beam 36 is braced to the leg 35 by a hand operated hydraulic jack 38**.

The module **22*a* also carries outboard of the cantilever support frame 26 a trolley 39 having four flanged wheels 40 which engage the top surface of the module. The trolley 39 supports a sling 41 which can be attached via connectors 42 to the sling sockets 11** of the bridge end module 2 (FIG. 1). The sling 41 is normally kept pinned to the trolley 39 by a removable pin 43.

The trolley 39 can be traversed along the launch rail in a direction towards the vehicle by means of a winch rope 44 which passes around guide pulleys 45 and 46 to a first hydraulic winch 47*a*, all mounted on the cantilever support frame 26. Traverse in the opposite direction is by means of a winch rope 48 which connects with a second hydraulic winch 47*b* (not visible) mounted on the cantilever support frame 26 via a guide pulley 49 mounted at the outboard end of the module 22*a*, pulley 70 attached to the trolley 39, pulley 71 attached to the sling 41 and pulley 72 attached to the trolley (see also FIG. 4).

As assembly and advancement of the launch rail proceeds, the winch rope 48 is paid off its winch so as to maintain the trolley 39 in the same position relative to the cantilever support frame 26. When required the sling 41 can be lowered from the trolley 39 after removal of the pin 43, by paying out the winch rope 48 (see FIG. 4).

The launch vehicle 21 carries a bridge module support frame 50 comprising a telescopic cross-beam 51, the extended ends of which are supported in use by two retractable ground stabilizing pads 52 attached to the cross-beam by jacks 53.

The cross-beam 51 carries a feed frame comprising four parallel rockers 54 rotatable about an axis parallel with the cross-beam each carrying a feed roller 55 at each end, the rockers being disposed along the length of the cross-beam as symmetrical pairs one on each side of the launch rail so as to be engageable with the twin track-ways 3 and 4 or 8 and 9 of the bridge modules 1 or 2.

The launch vehicle 21 also carries at each side, forward of the cross-beam 51 and in line with the rockers 54, a bridge module assembly frame 56 onto which bridge modules are successively loaded for assembly. This frame can be angularly deflected to match the slope of the launch rail by means of a jack 57.

The crane 31 is used for lifting the bridge modules as well as for lifting the launch rail modules, and a retractable stabilizing jack 58 is fitted at both ends of a transverse crane mounting beam 59 so that the operating platform can be levelled and risk of overload on the vehicle suspension eliminated.

The assembly and launch procedure for the launch rail is as illustrated in FIG. 2, the rail being cantilevered successively further across the gap to be bridged, by means of the motor 28 as each additional module 22 is attached. When the rail is sufficiently extended, the ground bearing pads 37 are lowered onto the far bank by adjusting the angle of the cantilever support frame 26. The hydraulic jack 38 can be manually adjusted to level the cross-beam 36 supporting the pads 37 by a man who has crossed to the far bank.

Assembly and launch of the bridge span is as illustrated in FIG. 3, the twin end track-ways 8 and 9 first being lifted from adjacent vehicles 60 and 61 onto the bridge module support and assembly frames 50 and 56 on either side of the launch vehicle 21 and there positioned for attachment to the sling 41. After attachment the track-ways are advanced sufficiently along the launch rail 20 by means of the winch 47*b* to permit connection of the bracing frame 10 and inter-connection of the next successive track-ways 3 and 4. The conjoined track-ways are then further advanced to permit connection of the braces 5 and connectors 6 and 7 and the process continued until the whole span is suspended across the gap.

The far bank end of the span is then lowered to the ground as illustrated in FIG. 4 by paying off the winch rope 48, after releasing the pin 43 which secures the sling 41 to the trolley 39. The home bank end is lowered as illustrated in FIG. 5 by means of a hoist rope 62 operative between the cantilever support frame 26 and a track-way cross-brace 63. Thereafter the sling 41 and the hoist rope 62 are disconnected from the bridge span and the launch rail retracted and dismantled in reverse order to the launch.

The bridge span can be removed from the gap by reversing the whole procedure.

This embodiment permits the launching of bridge span lengths of up to 32 meters weighing 12,500 Kg in 30 minutes from a vehicle weighing 22,000 Kg laden and having a wheel base length of 5.3 meters. The span can be launched from a bank with steep approaches, provided that the bank is reasonably level for about eight meters back from the gap edge.

It will be apparent to those skilled in the art that longer spans can be launched in accordance with the invention by suitable variations in design. For example the cantilever support frame can be mounted upon a rearwardly extensible, ground bearing portion of the launch vehicle, with the advantage of increased vehicle counterweight effect, as well as enabling bridge modules of greater length to be assembled.

In an alternative arrangement the launch vehicle may comprise a trailer towed behind a bridge module transporter, the bridge modules being conveniently stacked or hinged together so as to feed successively onto the trailer at either side of the launch rail.

I claim:

1. A launching apparatus for a transportable bridge having a plurality of bridge span modules inter-engageable end-to-end to form a bridge span, including an extensible launch rail comprising a plurality of launch rail modules inter-engageable end-to-end; a cantilever support frame having guide rollers engageable with the launch rail to support the launch rail against the cantilever bending moment of the rail; drive means for advancing and retracting the launch rail through said cantilever support frame; a ground engageable support member attachable adjacent the end of the launch rail remote from the cantilever support frame; and a launch trolley driveable on the launch rail and adapted for underslinging one end of the bridge span so as to advance and retract the bridge span beneath the launch rail.

2. A launching apparatus as claimed in claim 1 wherein the cantilever support frame is angularly deflectable about an axis which is both normal to the launch rail and substantially horizontal in use.

3. A launching apparatus as claimed in claim 1 wherein said drive means comprises a hydraulic motor having at least one rotatable drive member engageable with the launch rail.

4. A launching apparatus as claimed in claim 1 wherein the ground engageable support member comprises a bipedal leg pendently attachable to the launch rail.

5. A launching apparatus as claimed in claim 1 wherein the launch trolley is cable driven by winch means mounted on the cantilever support frame.

6. A launching apparatus as claimed in claim 1 further including a vehicle upon which the cantilever support frame is deflectably mounted.

7. A launching apparatus as claimed in claim 6 wherein the vehicle is provided with a bridge span module support frame which is angularly deflectable about an axis parallel to the deflection axis of the cantilever support frame.

8. A launching apparatus as claimed in claim 6 wherein the vehicle is provided with a crane.

* * * * *